US008939162B2

(12) United States Patent
Winkler et al.

(10) Patent No.: US 8,939,162 B2
(45) Date of Patent: Jan. 27, 2015

(54) VARIABLE SPRAY-PATTERN IN WATER-USING CLEANING APPLIANCES

(75) Inventors: Ralf Winkler, New Bern, NC (US); Christian Wolf, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 458 days.

(21) Appl. No.: 12/749,588

(22) Filed: Mar. 30, 2010

(65) Prior Publication Data

US 2011/0240060 A1 Oct. 6, 2011

(51) Int. Cl.

| | |
|---|---|
| ***A47L 15/14*** | (2006.01) |
| ***A47L 15/16*** | (2006.01) |
| ***A47L 15/42*** | (2006.01) |
| ***B08B 3/02*** | (2006.01) |
| ***B08B 3/04*** | (2006.01) |

(52) U.S. Cl.
CPC ..... *A47L 15/14* (2013.01)
USPC ..... 134/198; 134/56 D; 134/57 D; 134/58 D

(58) Field of Classification Search
USPC ..... 134/56 D, 57 D, 58 D, 198
See application file for complete search history.

(56) References Cited

U.S. PATENT DOCUMENTS

| | | | | |
|---|---|---|---|---|
| 2,980,123 | A * | 4/1961 | Lemelson | 134/184 |
| 3,854,998 | A * | 12/1974 | Jacobs | 134/191 |
| 4,135,531 | A * | 1/1979 | Federighi et al. | 134/95.3 |
| 5,697,392 | A * | 12/1997 | Johnson et al. | 134/176 |
| 5,924,432 | A | 7/1999 | Thies et al. | |
| 7,225,818 | B2 | 6/2007 | Kim et al. | |
| 7,255,113 | B2 | 8/2007 | Elick et al. | |
| 2006/0108454 | A1 | 5/2006 | Eichholz | |
| 2007/0079850 | A1 | 4/2007 | Jerg et al. | |
| 2007/0295361 | A1 | 12/2007 | Thiyagarajan et al. | |
| 2009/0145981 | A1 * | 6/2009 | Mack et al. | 239/261 |
| 2009/0178698 | A1 | 7/2009 | Delgado | |
| 2011/0203619 | A1 * | 8/2011 | Kara et al. | 134/174 |

FOREIGN PATENT DOCUMENTS

WO WO 2009021626 A1 * 2/2009 ..... A47L 15/22

* cited by examiner

*Primary Examiner* — Joseph L Perrin
*Assistant Examiner* — Levon J Shahinian
(74) *Attorney, Agent, or Firm* — James E. Howard; Andre Pallapies

(57) ABSTRACT

A dishwasher including a variable spray device operable to spray a liquid into a washing container of the dishwasher, the variable spray device, and a method thereof. The variable spray device may be structured to include a chamber for receiving the liquid therein, such as a dishwashing liquid or water, and a liquid deflector disposed in the chamber. The liquid deflector may have a geometrically shaped perimeter, for example, a conical shape, that allows for the generation of a centrifugal force within the chamber used in directing the spray of the liquid into the washing container. By varying a force or pressure of the liquid as it interacts with the liquid deflector in the chamber, variable spray patterns may be generated.

12 Claims, 2 Drawing Sheets

VARIABLE SPRAY-PATTERN IN WATER-USING CLEANING APPLIANCES

BACKGROUND OF THE INVENTION

1. Field of the Invention

The present invention relates to a dishwasher and more particularly, to a dishwasher including a variable spray device operable to direct and spray a liquid, such as dishwashing liquid or rinse liquid, in predetermined patterns during a washing process.

2. Related Art

In a dishwasher, usually one or more washing processes are carried out in the course of the washing operation in order to clean the items to be washed, for example, dishes and other eating and cooking utensils. In related art dishwashers, a washing liquid may be sprayed into a dish container portion of the dishwasher by means of a spraying assembly typically employing spray arms. As a result of the continuous circulation and action of the washing liquid provided by the spray arms onto the dishes, and subsequent rinse cycles, the dishes are cleaned.

The spray arms in related art dishwashers may be mounted at various locations within the dish container portion including at a bottom base, a side, and an upper area of the dishwasher. The spray assembly may include a fluid pump and a spray tower and other known means of providing the washing liquid to the spray arms. The spray tower may include the rotatable spray arms, each having one or more spray openings. One such device is disclosed in U.S. Pat. No. 5,697,392 which discloses a spray assembly with a rotating wash arm 58 and spray nozzle 64. Another such device is disclosed in U.S. Patent Publication No. 2007/0295361 which discloses a spray device 50 including a hub 52. First and second spray arms 54 and 56 are mounted to the hub 52 and configured to introduce a solvent such as water within the dish washing chamber 14 depending on the mode of the cleaning operation.

In each of these configurations, the related art and its use of a series of multiple and rotating spray arms to create spray patterns can become quite complex and costly. The present invention overcomes the problems associated with the related art by introducing a spray device that eliminates the need for one or more rotating spray arms, and the associated structure used to rotate the spray arms.

SUMMARY OF THE INVENTION

A first aspect of the present invention is directed to a dishwasher operable of generating variable spray patterns. The dishwasher may include a washing container; and a variable spray device structured to spray a liquid into the washing container.

A second aspect of the present invention is directed to the aforementioned variable spray device. The variable spray device may include a chamber for receiving a liquid, such as a dishwashing liquid or rinse liquid therein, and a liquid deflector disposed in the chamber. The liquid deflector may have a geometrically shaped perimeter that allows for the generation of a centrifugal force within the chamber and which is used in directing the spray of the liquid into the washing container. In an exemplary embodiment, the geometrically shaped perimeter of the liquid deflector may be of a conical shape.

A third aspect of the present invention is directed to a method of creating variable spray patterns in a dishwasher. In an exemplary method of the invention, liquid is directed to interact with a liquid deflector disposed in a chamber of the dishwasher. The interaction may be controlled such as to generate a centrifugal force within the chamber which is used in directing a resulting spray of the liquid into the washing container. The interaction may be controlled by controlling at least one of a flow rate and pressure of the liquid at least one of prior to and during the interaction. In this manner, predetermined spraying patterns may be provided during a washing operation.

The illustrative aspects of the present invention are designed to solve the problems herein described and other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various exemplary embodiments of the disclosure, in which.

Figure 1:
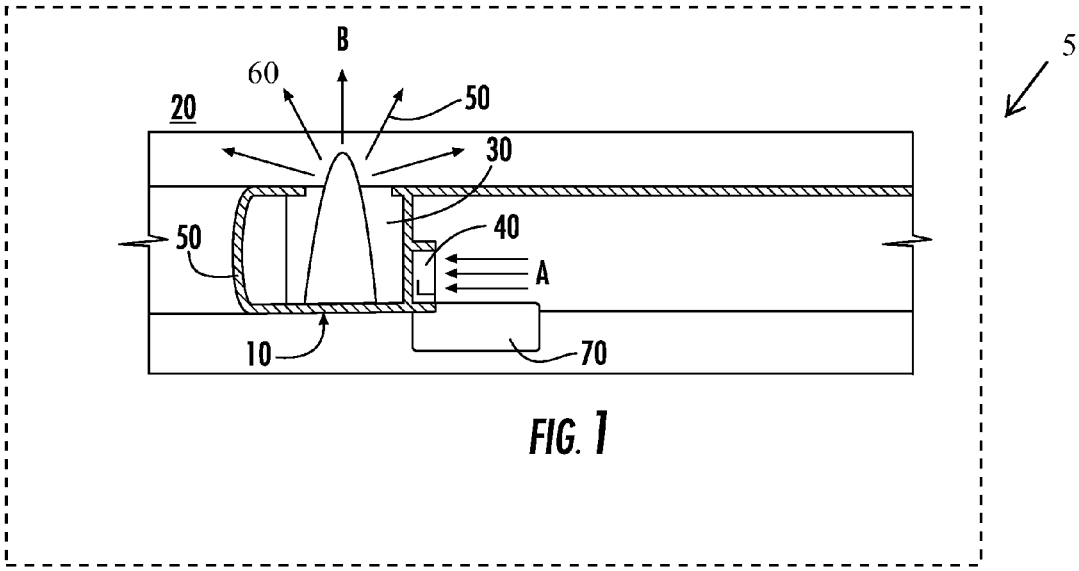
FIG. 1 depicts a spraying device according to an exemplary embodiment of the present invention.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

FIG. 1 shows an exemplary embodiment of a spraying device 10 according to the present invention. The spraying device 10 may be incorporated into a washing device, such as a dishwasher 5, and used during wash and rinse cycle operations of the dishwasher 5.

While not depicted in FIG. 1, the physical structure of the dishwasher of the present invention outside of the novel spraying device described herein may be any dishwasher structure known in the related art and may include a washing container and an electrical control and regulating electronics module housed inside, for example, a door of the dishwasher, and operable to execute various washing operations within the washing container. The electronics module may include a memory storing a program having instructions, which when executed, direct and control the washing operations.

As shown in FIG. 1, the spraying device 10 may include a liquid deflector 20 disposed within a chamber 30 formed by a plurality of walls 50 surrounding the liquid deflector 20.

Cleaning liquid or rinse water may be directed through channel 40 into the chamber 30 in a direction of A. The channel 40 may extend into the chamber 30 or end at an opening of the chamber 40 (not shown) such that the cleaning liquid or rinse liquid is directed towards the liquid deflector 30.

One or more spraying devices 10 may be positioned in the dishwasher such that an efficient cleaning operation may be carried out. The cleaning liquid or rinse liquid interacts with the liquid deflector 20 and is exited from the chamber 30 towards an inside of the washing container housing dishes in the direction of B as shown. The walls 50 may surround the liquid deflector 20 such that an opening 60 is formed for exiting the cleaning liquid or rinse liquid from the chamber 40.

The pattern formed as the cleaning liquid or rinse liquid exits the chamber 30 may be predetermined based on the shape of the liquid deflector 20, a flow rate of the cleaning liquid or rinse liquid as it enters the chamber 30 and/or interacts with the liquid deflector 20, and a pressure of cleaning liquid or rinse liquid.

In an exemplary embodiment of the invention, the liquid deflector 20 may include a geometrically shaped perimeter of a conical shape, although the shape of the liquid deflector 20 is not limited to this shape, but may be any shape that allows for creating forces, such as a centrifugal force within the chamber 30 as the liquid meets or strikes the geometrically shaped perimeter of the liquid deflector 20.

Further, the liquid deflector 20 may include various patterns or surface topology formed in or attached to the surface of the liquid deflector 20 that may be used in creating flow forces and/or directing a resulting spray. A material of the fluid deflector 20 may also be selected from materials known in the art that help to create or reduce fluid forces.

To control or vary the flow rate of the cleaning liquid or rinse liquid as it enters the chamber 30 and/or interacts with the liquid deflector 20, as well as a pressure of cleaning liquid or rinse liquid, the variable spray device 10 may further include a flow control device 70. The flow control device 70 may be structured to control at least one of the flow rate and pressure of the liquid received into the chamber 30 through the channel 40. Flow control devices used in the related art may be used, and as such, are not discussed in detail herein.

By controlling and/or by varying the at least one of a flow rate and pressure of the liquid using the flow control device 70, one or more predetermined spray patterns may be created in conjunction with the centrifugal force generated as the liquid interacts with the liquid reflector 20 in the chamber 30. For example, in the invention, the flow rate and pressure of the liquid may interact with the fluid deflector 20 such that it spins at high velocity around the cone wall of the fluid deflector 20 creating resultant forces used to expel the liquid in a predetermined spray pattern.

Figure 2:
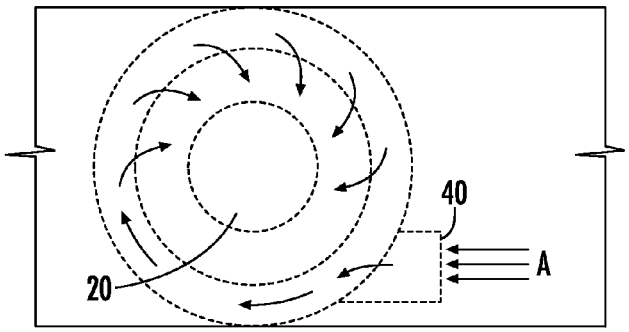
FIG. 2 depicts a centrifugal force created by a liquid interacting with a liquid deflector of the spraying device according to an exemplary embodiment of the invention.
Figure 3:
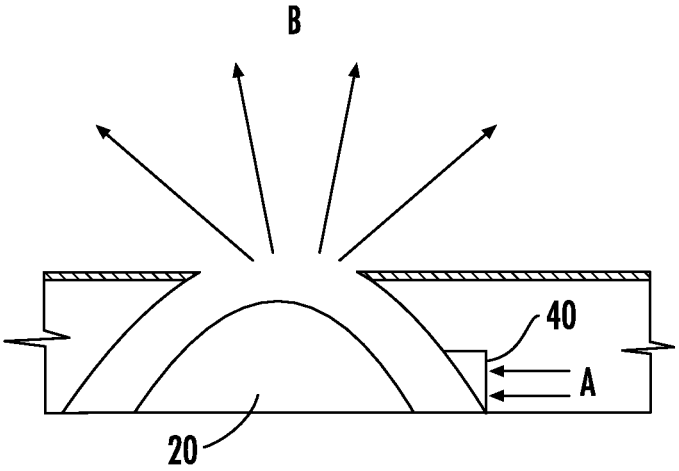
FIG. 3 depicts a predetermined spray pattern emitting from the spraying device according to an exemplary embodiment of the invention.

FIG. 2 depicts a centrifugal force created by the liquid interacting with the liquid deflector 20 of the spraying device 10 according to an exemplary embodiment of the invention. As shown in FIG. 2, the conical shape of the liquid deflector 20 creates a centrifugal force causing the liquid to rotate about the liquid deflector 20, where it exits the chamber 30 in the direction of B in a predetermined spray pattern. FIG. 3 shows an example of the aforementioned predetermined spray pattern emitting from the spraying device 10 according to an exemplary embodiment of the invention.

Along similar lines as described using FIGS. 1-3, in an exemplary method of the invention of creating variable spray patterns in a dishwasher, the method may include directing a liquid to interact with a liquid deflector 20 disposed in the chamber 30 of the dishwasher. Subsequently, this interaction is controlled to generate a centrifugal force within the chamber used in directing a resulting spray of the liquid into the washing container.

By varying at least one of a flow rate and pressure of the liquid, predetermined spray patterns may be generated in conjunction with the creation of the centrifugal force as the liquid interacts with the liquid reflector in the chamber.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A dishwasher having variable spray patterns and having no spray arms, the dishwasher comprising:

a washing container;

a variable spray device structured to spray a liquid into the washing container, the variable spray device including a chamber for receiving the liquid therein and a liquid deflector disposed at a bottom portion of the chamber, the liquid deflector having a geometrically shaped perimeter that allows for the generation of a centrifugal force within the chamber used in directing the spray of the liquid into the washing container, wherein the liquid directly enters the washing container after contacting the liquid deflector; and a horizontal channel at a bottom position of the chamber structured to direct the liquid in a horizontal direction towards an external surface of the deflector and into the chamber.

2. The dishwasher of claim 1, wherein the geometrically shaped perimeter of the liquid deflector is of a conical shape.

3. The dishwasher of claim 1, wherein the centrifugal force is generated as the liquid meets the geometrically shaped perimeter of the liquid deflector.

4. The dishwasher of claim 1, wherein the variable spray device further includes a flow control device, the flow control device structured to control at least one of a flow rate and pressure of the liquid received into the chamber.

5. The dishwasher of claim 4, wherein by varying the at least one of a flow rate and pressure of the liquid using the flow control device, one or more predetermined spray patterns are created in conjunction with the centrifugal force generated as the liquid meets the liquid deflector in the chamber.

6. The dishwasher of claim 1, wherein the liquid defector is a structural object having no moving electrical or mechanical parts.

7. A variable spray device not disposed on a spray arm operable to spray a liquid into a washing container, the variable spray device comprising:

a chamber for receiving the liquid therein;

a liquid deflector disposed at a bottom portion of the chamber, the liquid deflector having a geometrically shaped perimeter that allows for the generation of a centrifugal force within the chamber used in directing the spray of the liquid into the washing container, wherein the liquid directly enters the washing container after contacting the liquid deflector; and a horizontal channel structured at a bottom position of the chamber to direct the liquid in a horizontal direction towards an external surface of the liquid deflector and into the chamber.

8. The variable spray device of claim 7, wherein the geometrically shaped perimeter of the liquid deflector is of a conical shape.

9. The variable spray device of claim 7, wherein the variable spray device further includes a flow control device, the flow control device structured to control at least one of a flow rate and pressure of the liquid received into the chamber.

10. The variable spray device of claim 9, wherein by varying the at least one of a flow rate and pressure of the liquid using the flow control device, one or more predetermined spray patterns are created in conjunction with the centrifugal force generated as the liquid meets the liquid deflector in the chamber.

11. The variable spray device of claim 7, wherein the liquid defector is a structural object having no moving electrical or mechanical parts.

12. The variable spray device of claim 7, wherein the centrifugal force is generated as the liquid meets the liquid deflector in the chamber.

* * * * *